US008595059B1

(12) United States Patent
Huang

(10) Patent No.: US 8,595,059 B1
(45) Date of Patent: Nov. 26, 2013

(54) FORWARDING OFFERS FOR PAYMENT BY OTHERS

(75) Inventor: Andy Huang, Cupertino, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/271,284

(22) Filed: Oct. 12, 2011

(51) Int. Cl.
*G06Q 30/00* (2012.01)

(52) U.S. Cl.
USPC ..... 705/14.1; 705/14.23; 705/26.7

(58) Field of Classification Search
USPC ..... 705/14.1
See application file for complete search history.

(56) References Cited

U.S. PATENT DOCUMENTS

| | | | | |
|---|---|---|---|---|
| 5,754,981 | A * | 5/1998 | Veeneman et al. | 705/26.8 |
| 5,987,132 | A | 11/1999 | Rowney | |
| 6,297,819 | B1 * | 10/2001 | Furst | 715/733 |
| 6,868,393 | B1 | 3/2005 | Demsky et al. | |
| 7,433,845 | B1 | 10/2008 | Flitcroft et al. | |
| 7,647,247 | B2 | 1/2010 | Abraham et al. | |
| 2005/0065881 | A1 | 3/2005 | Li et al. | |
| 2007/0299736 | A1 | 12/2007 | Perrochon et al. | |
| 2008/0015988 | A1 | 1/2008 | Brown et al. | |
| 2009/0150266 | A1 | 6/2009 | Dickelman | |
| 2009/0204510 | A1 | 8/2009 | Hwang | |

OTHER PUBLICATIONS

Plotkin, "Re: Kohl's deleted my wedding registry", Planet Feedback, Dec. 20, 2006, found on line at planetfeedback.com/index.php?level2=blog_viewpost&topic_id=294170 &reply$_{13}$ id=81913.*

Ward (Catalogue No. 13, Montgomery Ward & Co., Chicago, Ill., 1875, found on line at archive.org/details/catalogueno13spr00mont.*

* cited by examiner

*Primary Examiner* — John G Weiss
*Assistant Examiner* — Scott C Anderson
(74) *Attorney, Agent, or Firm* — Johnson, Marcou & Isaacs, LLC

(57) ABSTRACT

A gift payment management system allows a user to redirect a payment request for selected offers to one or more potential purchasers. The gift payment management system monitors the potential purchaser's response. If the gift payment request is accepted by a potential purchaser, the gift payment management system facilitates verification of payment from the potential purchaser and notifies the user that the gift payment request was accepted. The product associated with the offers is then made available to the user. If multiple purchasers are designated, the gift payment management system further withdraws the gift payment request after the request is completed.

24 Claims, 4 Drawing Sheets

FORWARDING OFFERS FOR PAYMENT BY OTHERS

TECHNICAL FIELD

The present disclosure relates generally to a payment system for online purchases and, more particularly, to methods and systems whereby a user can redirect a payment request for a selected offer to one or more potential purchasers to purchase the offer on the user's behalf.

BACKGROUND

Internet based purchases continue to become an increasingly common option for shoppers. In addition, the distribution of group-based offers is proving to be an effective marketing tool for driving Internet traffic to merchant websites and stores. While an increasing number of potential customers are being reached through such measures, many potential customers refrain from purchasing. For example, a college student may desire to purchase certain products but will not or cannot complete the purchases because of a limited budget. Another individual may see an item they like and desire to suggest the item as a gift for another person to purchase. Current online purchasing models are based on self-pay and purchase requirements. Customers do not have the ability to select items and then seamlessly complete the transaction by redirecting the payment request to a willing purchaser.

SUMMARY

In certain exemplary aspects, a method for distributing a gift payment request from a customer to one or more potential purchasers includes receiving a customer redirection payment request for one or more selected offers. The customer redirection payment request includes user information regarding the customer making the request, one or more offers the customer would like to receive, purchaser information, and the quantity of each offer requested per purchaser. The purchaser information includes contact information for distributing a gift request to one or more potential purchasers. A gift payment request is generated from the information contained in the customer redirection payment request and includes at least the offers to be purchased, the quantity requested from each potential purchaser, and identification information on the individual initiating the request. The gift payment request is linked to the customer's user account, the details of which may be stored in a purchase history associated with the account. The gift payment request is distributed to the selected purchasers. The purchasers may then accept, decline, or ignore the request. If the gift payment request is not accepted, the originating customer is notified that the transaction cannot be completed. If the gift payment request is accepted by a potential purchaser, the potential purchaser pays for the offer. Then, the originating customer is notified that the transaction is approved and is provided with either direct access to the product associated with the purchased offer or with a confirmation number or shipment tracking number.

These and other aspects, objects, features, and advantages of the exemplary embodiments will become apparent to those having ordinary skill in the art upon consideration of the following detailed description of illustrated exemplary embodiments, which include the best mode of carrying out the invention as presently perceived.

DETAILED DESCRIPTION OF EXEMPLARY EMBODIMENTS

Overview

Figure 1:
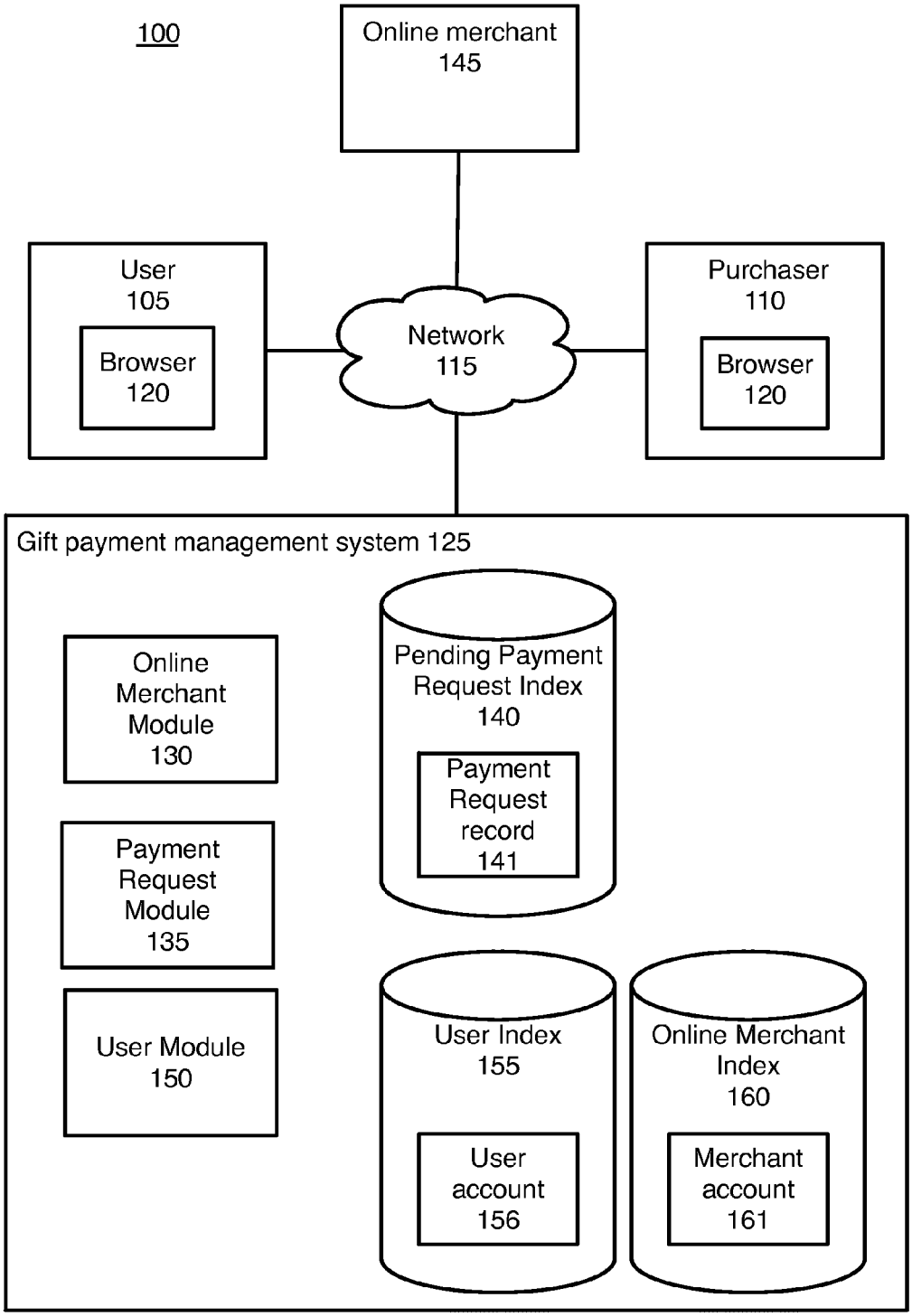
FIG. 1 is a block diagram depicting a system for redirecting offers to potential purchasers according to an exemplary embodiment.

The methods and systems described herein enable customers to purchase items online by selecting one or more items they wish to receive and to redirect the payment request for such items to another party for payment on the customer's behalf. A user interface is established that allows users to select the gift payment option when providing payment information for an electronic purchase. Instead of providing personal payment information, the customer provides one or more other purchasers that may be willing to pay for the purchase on the customer's behalf. A gift payment request is generated containing the customer name, or other identifier, and information on the items to be purchased and the quantity requested from each purchaser. The information on the items to be purchased can include links to an online merchant's catalogue or other source of product information. In certain exemplary embodiments, the customer also may include a personal message for each potential purchaser. The gift payment request is then distributed to the one or more potential purchasers. The gift payment request can be distributed by e-mail, via a social network, MMS text messaging, or other suitable method. An administrator or customer-defined time limit may be applied to the gift payment request. If a purchaser does not accept the gift payment request within the time limit, the gift payment request expires, and the customer is notified that the transaction cannot be completed. If a purchaser accepts the offer, purchaser payment information is provided and verified. The customer is then notified that the gift payment request has been accepted and that the transaction is completed. The customer may then be provided with direct access to the purchased items. If more than one of the item was requested, the system determines if the requested amount was purchased. If the full requested quantity of items was purchased, any remaining potential purchasers are notified that the request is now withdrawn.

As used throughout this specification, the term "product" should be interpreted to include tangible and intangible products, as well as services. As used herein "group offer" refers to an electronically distributed offer for sale of a product, where the terms of the sale are predicated on attaining a certain number of purchasers or other purchasing criteria.

One or more aspects of the invention may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing the invention in computer programming, and the invention should not be construed as limited to any one set of computer program instructions. Further, a skilled programmer would be able to write such a computer program to implement an embodiment of the disclosed invention based on the appended flow charts and associated description in the application text. Therefore, disclosure of a particular set of program code instructions is not considered necessary for an adequate understanding of how to make and use the invention. Further, those skilled in the art will appreciate that one or more aspects of the invention described herein may be performed by hardware, software, or a combination thereof, as may be embodied in one or more computing systems. Moreover, any reference to an act being performed by a computer should not be construed as being performed by a single computer as the act may be performed by more than one computer. The inventive functionality of the invention will be explained in more detail in the following description, read in conjunction with the figures illustrating the program flow.

Turning now to the drawings, in which like numerals indicate like (but not necessarily identical) elements throughout the figures, exemplary embodiments are described in detail.

System Architecture

FIG. 1 is a block diagram depicting a system 100 for redirecting offers to potential purchasers according to an exemplary embodiment. As depicted in FIG. 1, the system 100 includes network devices 105, 110, 125, and 145 that are configured to communicate with one another via one or more networks 115.

Each network 115 includes a wired or wireless telecommunication means by which network devices (including devices 105, 110, 125, and 145) can exchange data. For example, each network 115 can include a local area network ("LAN"), a wide area network ("WAN"), an intranet, an Internet, a mobile telephone network or mobile device network, Wi-Fi, other communication network, or any combination thereof. Throughout the discussion of exemplary embodiments, it should be understood that the terms "data" and "information" are used interchangeably herein to refer to text, images, audio, video, or any other form of information that can exist in a computer-based environment.

Each network device 105, 110, 125, 145 includes a device having a communication module capable of transmitting and receiving data over the network 115. For example, each network device 105, 110, 125, 145 can include a server, desktop computer, laptop computer, tablet computer, smart phone, handheld computer, personal digital assistant ("PDA"), or any other wired or wireless, processor-driven device. In the exemplary embodiment depicted in FIG. 1, the network devices 105, 110, 125, 145 are operated by end-users, offer purchaser(s), a gift payment management system operator, and a merchant or electronic offer provider, respectively.

Although only a single network device 105, 110, and 145 are depicted in FIG. 1 for simplicity, multiple such network devices 105, 110, and 145 are contemplated.

The end user network devices 105 and offer purchase network device 110 may each include an application module 120. The application module may be a browser application, such as Internet Explorer®, Firefox®, Navigator®, Chrome®, Safari®, or some other suitable application for interacting with web page files maintained by the gift payment management system 125 and/or other network devices. The web page files can include text, graphic, images, sound, video, and other multimedia or data files that can be transmitted via the network 115. For example, the web page files can include one or more files in the Hypertext Markup Language ("HTML"). The browser application module 120 can receive web page files from the gift payment management system 125 and can display web page files to an end user operating the end user network devices 105, 110. The application 120 also may be an application operating on the network device for receiving, communicating, and displaying data.

In certain exemplary embodiments, the gift payment management system 125 comprises an online merchant module 130, a payment request module 135, a user module 150, a pending payment request index 140 comprising pending payment request records 141, a user index 155 comprising user records 156, and an online merchant index 160 comprising merchant accounts 161.

In certain exemplary embodiments, the online merchant module 130 communicates with the online merchant network device 145 to receive offer information for establishing a gift payment processing account. The online merchant module 130 is in communication with the online merchant index 160 and stores online merchant identification and other information needed to interface with the online merchant's payment processing system included in the online merchant network device 145. The online merchant module 130 also generates a user interface that allows users to select, via the user network device 105, the gift payment option when selecting items the user would like to purchase from an online merchant catalog or distributed electronic offer.

The payment request module 135 receives gift payment requests from users who have selected an item or offer they would like to receive. The gift payment request can include a list of potential purchasers, which can be contacted via corresponding purchaser network devices 110. The payment request module 135 is in communication with a pending payment request index 140 and stores the pending payment request information in the payment request record 141. The payment request module 135 distributes the request to one or more selected purchasers via corresponding purchaser network devices 110. The payment request module 135 then monitors the purchasers' response to the request. When a purchaser accepts the request and the request is fulfilled, the payment request module 135 notifies the user and withdraws the payment request from other selected purchasers. The payment request module 135 also monitors the validity of the offer and cancels the gift payment request after a pre-defined amount of time has lapsed, or via direct request from the user.

In certain exemplary embodiments, the user module 150 generates a user interface for presentation on the user network device 105 that allows users to register for an electronic user account 156 with the system 125. The user module 150 is in communication with the user index 155 and stores a user's account information in the user account 156. The user account also allows specific gift payment request to be linked to a particular user. The user module 150 also may generate a user interface for presentation on the user network device 105 that allows a user to log on and access their account information, including outstanding gift payment requests, and to update account registration information.

The gift payment management system 125 is described in further detail hereinafter with reference to the methods depicted in FIGS. 2-4.

System Process

Figure 2:
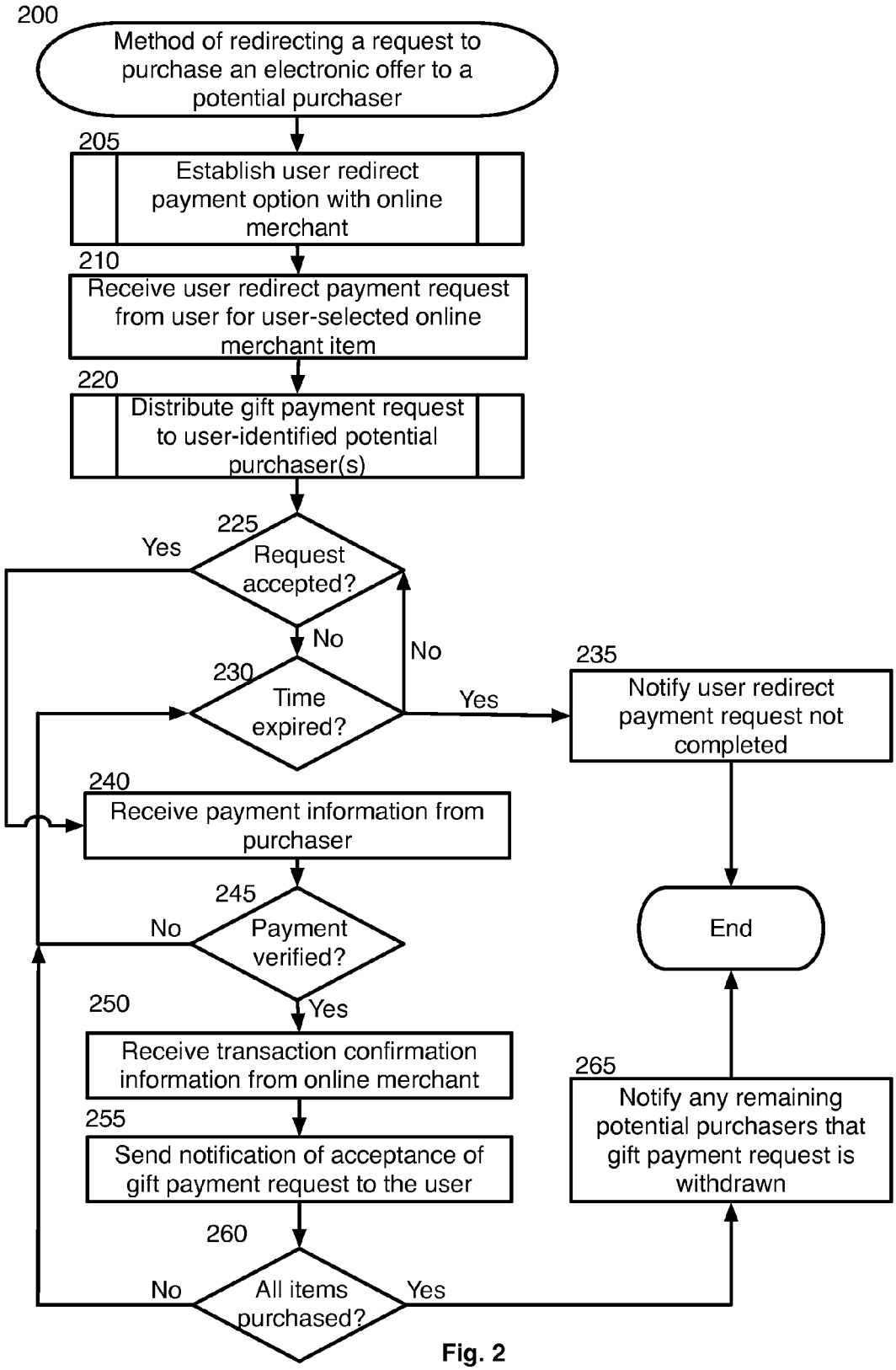
FIG. 2 is a block flow diagram depicting a method for redirecting a request to purchase an electronic offer or item to a potential purchaser or purchasers according to an exemplary embodiment.

FIG. 2 is a block flow diagram depicting a method 200 for redirecting a request to purchase an electronic offer to a potential purchaser according to an exemplary embodiment. The method 200 is described with reference to the components illustrated in FIG. 1.

At block 205, the online merchant module 130 receives an online merchant request from the online merchant network device 145 to establish a gift payment processing option for online web site(s), electronically distributed offers, or other media incorporating a listing of items for sale and one or more payment options. Based on the request, a customer redirection payment option is established with the online merchant. Per block 205, offers may be presented via the user network device 105, wherein payment for such offers can include an option to redirect payment from a user of the network device 105 to a potential purchaser operating the purchaser network device 110. Block 205 will be described in further detail hereinafter with reference to FIG. 3.

Figure 3:
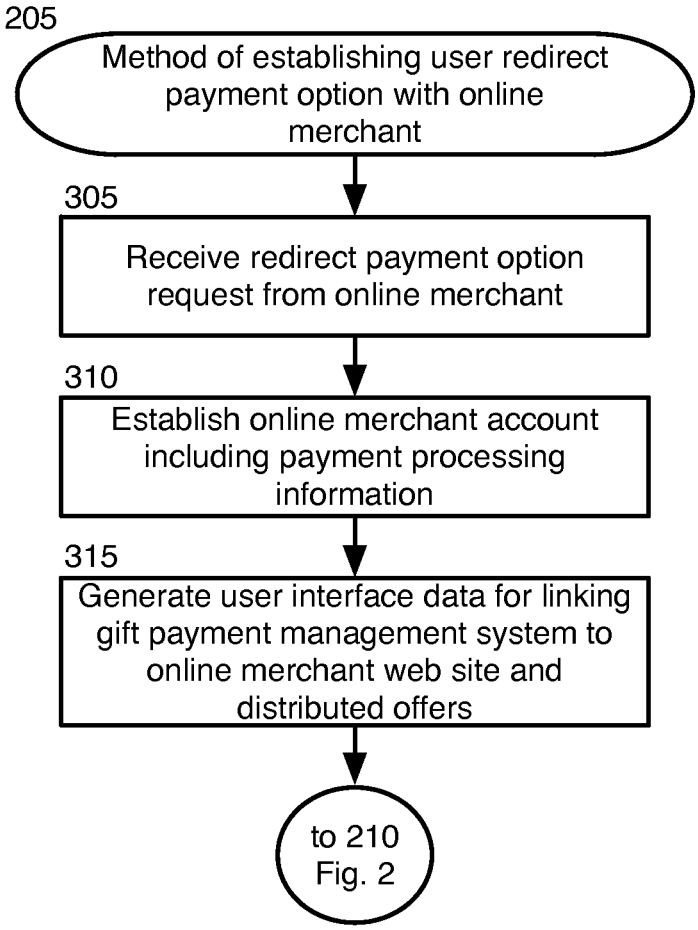
FIG. 3 is a block flow diagram depicting a method for establishing a customer redirection payment option with an online merchant according to an exemplary embodiment

FIG. 3 is a block flow diagram depicting a method 205 for establishing a customer redirection payment processing option with an online merchant according to an exemplary embodiment, as referenced in block 205 of FIG. 2. Thus, FIG. 3 describes the process 205 by which an online merchant establishes customer redirection payment processing through the gift payment management system 125.

At block 305, the online merchant module 130 receives a customer redirection payment option request from an online merchant. In an exemplary embodiment, the online merchant may operate the online merchant network device 145 to communicate the request to the gift payment management system 125 via the network 115.

At block 310, the online merchant establishes a merchant account 161 in the online merchant index 160. For example, the online merchant module 130 can communicate an information request to the online merchant network device 145. In response, the online merchant can input the requested information into the online merchant network device 145, which is then communicated to the online merchant module 130. The online merchant module 130 store the online merchant's information in the merchant account 161 of the online merchant index 160. The information requested and therefore included in the merchant account 161 includes online merchant information including relevant server information needed for the gift payment management system 125 to interface with the online merchant's payment processing system. For example, the online merchant information can comprise merchant name, address(es), contact information, domain name, product information, offer information, payment and payment account information, and other suitable information.

At block 315, the online merchant module 130 generates user interface data for linking the gift payment management system 125 to the online the online merchant's payment processing system (specifically, to the online merchant network device 145 comprising the payment processing system) and/or to distributed offers of the online merchant. The user interface allows users to select the redirection payment option to pay for items they desire to receive from the online merchant website or through electronically distributed offers. The method 205 then proceeds to block 210 of FIG. 2.

At block 210, the payment request module 135 receives a customer redirected payment request from a user, whereby the user would like to purchase an offer and have someone else pay for the offer.

In an exemplary embodiment, the user may operate the user network device 105 to select a "redirect payment option" presented via the application 120 on the user network device 105 when the user elects to purchase an offer. In response to the selection, the user network device 105 communicates the redirection payment request to the payment request module 135, either directly or via the online merchant network device 145.

In an exemplary embodiment, the user may select the "redirect payment option" when purchasing a product via the user network device 105. The "redirect payment option" can be presented to the user when the user is viewing payment options or a payment user interface presented in connection with a product web page or a distributed electronic product offer (including a group product offer). The user may user the user network device 105 to view web pages hosted by the online merchant network device 145, the gift payment management system 125, or another network device hosting product or product offer web pages. Alternatively, the online merchant network device 145, the gift payment management system 125, or another network device may communicate product offers to the user network device 105. When the user selects, via the user network device 105, a product offer for purchase, payment options, including the "redirect payment option," can be presented on the user network device 105. In response to selection of the "redirect payment option," the user network device 105 communicates the redirection payment request to the payment request module 135, either directly or via the online merchant network device 145.

At block 220, the payment request module 130 generates and distributes a gift payment request to user-identified potential purchasers, in response to receiving the customer redirection payment request in block 210. Block 220 will be described in further detail hereinafter with reference to FIG. 4.

Figure 4:
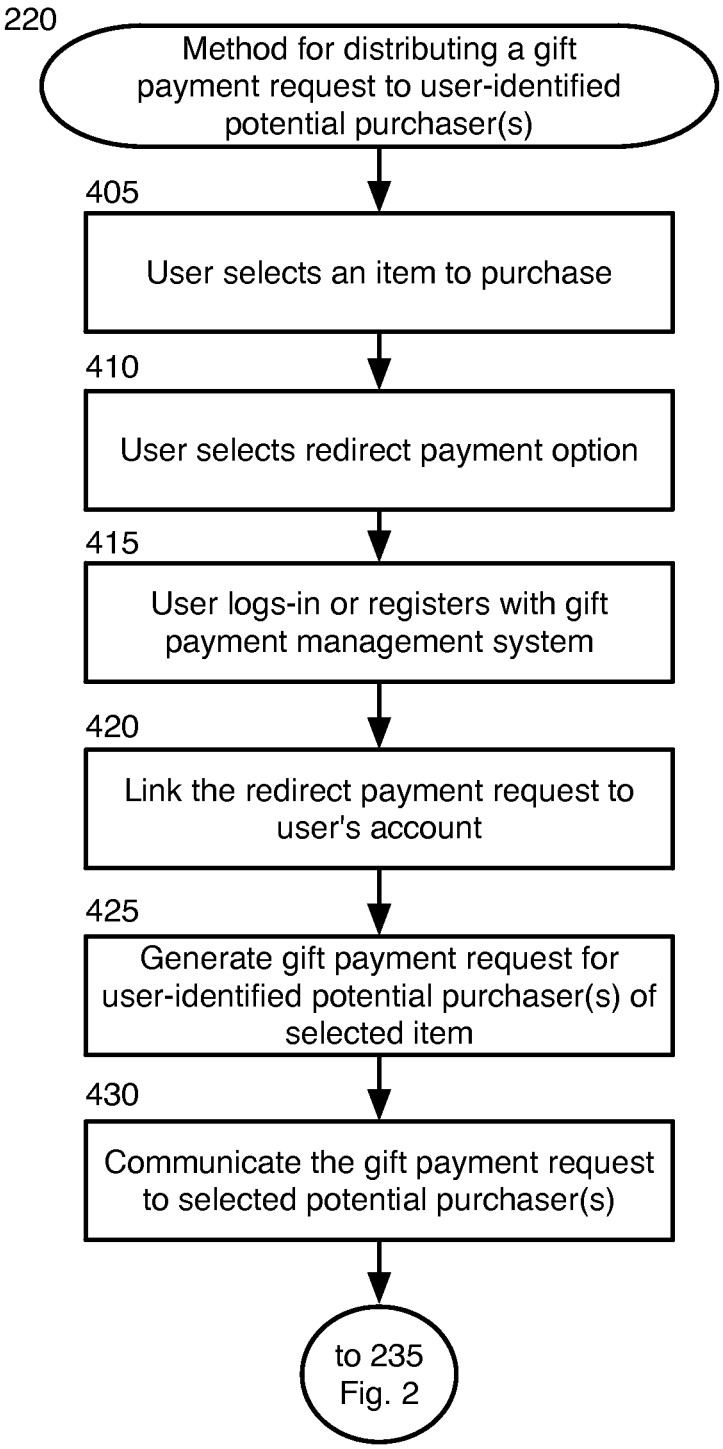
FIG. 4 is a block flow diagram depicting a method for distributing a gift payment request to user-identified potential purchasers according to an exemplary embodiment.

FIG. 4 is a block flow diagram depicting a method 220 for distributing a gift payment request to user-identified potential purchasers according to an exemplary embodiment, as referenced in block 220 of FIG. 2. Thus, FIG. 4 describes the process by which a user applies a gift payment request to one or more selected items, and the gift payment request is communicated to at least one potential purchaser.

At block 405, a user selects an item they wish to receive from an online merchant's website or an electronically distributed offer. For example, the user may select to purchase the item via the user network device 105. Upon selection of an item to purchase, the user network device 105 may present options to pay for the item. The options may include a control for the "redirect payment option."

At block 410, the user selects, via the user network device 105, the redirect payment option. Upon selection, the user network device 105 communicates a redirect payment request to the user module 150, either directly or via the online merchant network device 145.

At block 415, the user module 150 receives the redirect payment request from the user network device 105 and prompts the user to log in or register for a user account 156. If the user already has an account with the gift payment management system 125, the user is prompted to log into the account, thereby providing access to the user's account information stored in the user account 156 of the user index 155. If the user does not have an account, the user is prompted to register with the gift payment management system to create a user account 156 in the user index 155.

The user account 156 comprises a unique user id assigned to the user, such as an account number or other identifier. The user account 156 may further comprise additional information, such as a password, user name, contact information (for example, e-mail address, telephone number, facsimile number, social network account information, or other suitable contact information), physical shipping address, and/or other suitable information.

At block 420, the user module 150 links the redirect payment request to the user account 156 and communicates the redirect payment request to the payment request module 135.

At block 425, the payment request module 135 receives the linked redirect payment request and generates a gift payment request to be sent to potential purchasers. Accordingly, the payment request module 135 prompts the user, via the user network device 105, to enter potential purchaser information for one or more potential purchasers. The purchaser information can include purchaser identifying information, such as an e-mail address, social network identifier, instant message identifier, phone number at which SMS/MMS text can be received, or other suitable contact information for each potential purchaser. In certain exemplary embodiments, the payment request module 135 also may provide, via the user network device 105, a user interface allowing the user to enter a personalized message for each potential purchaser. The user interface also may allow the user to specify the total quantity of items requested and to designate how many of the item they are requesting from specific purchasers. In certain exemplary embodiments, the user may select a set quantity of the item to request from one purchaser. In another exemplary embodiment, the user may select a set quantity of items they wish to receive from multiple purchasers. For example, the user may select to receive 5 of a single item. The user can request all 5 items from a single user or send the request to multiple purchasers. Any individual purchaser could purchase up to 5 of the items for the user. Alternatively, the user can specify that they would like to receive 2 from one purchaser, 2 from a second purchaser, and 1 from a third purchaser.

The payment request module 135 then generates the gift payment request to be communicated to each potential purchaser. The gift payment request includes information such as the user's identifying information, a description of the item requested, the amount requested per purchaser, and the online merchant through which the item is available. In addition, the gift payment request may include a link to the online merchant's website, which potential purchasers may access. The online merchant's website can provide additional information about the requested item. The gift payment request may further include access to a user interface or other control allowing the potential purchaser to accept or decline the gift payment request. The gift payment request also can include a time limit defining how long the gift payment request remains valid. The time limit may be defined by the user, defined by the particular offer available for the item, or may be set by a system administrator.

The gift payment request is stored in a payment request record 141 of the pending payment request index 140.

At block 430, the payment request module 135 distributes the gift payment request to the user-selected potential purchasers, via the corresponding purchaser network device 110 for each potential purchaser, using the contact information provided for each potential purchaser. The method 220 then proceeds to block 235 of FIG. 2.

At block 225, if no response is received or if a purchaser response is received to reject the gift payment request, the method 200 proceeds to block 230. At block 230, the payment request module 135 determines if the time limit for the gift payment request has expired. If the expiration limit has not been reached, and of additional purchaser's have not yet responded, the method 200 returns to block 225 and continues to monitor purchaser responses. If the expiration limit has been reached or if all potential purchasers have responded negatively, the method proceeds to block 235.

At block 235, the payment request module 135 generates a user notification and communicates the user notification to the user network device 105. The user notification indicates that the gift payment request could not be completed. From block 235, the method 200 ends.

Referring back to block 225, the payment request module 125 monitors the distributed gift payment request for a purchaser's response to be received from a purchaser network device 110. If a purchaser response to purchase the item is received from a purchaser network device 110, the method 200 proceeds to block 240.

At block 240, the payment request module 135 receives the purchaser's payment information. For example, the purchaser may operate the purchaser network device 110 to access the payment request module 135 to input the purchaser's payment information to pay for the item identified in the gift payment request. In certain exemplary embodiments, the payment request module 135 also may provide a user interface, via the purchaser network device 110, for the purchaser to submit a personalized message for communication to the user. In exemplary embodiments, the payment information comprises the purchaser's form of payment to pay for the item, such as a credit card, debit card, stored value card, bank account for direct debit, or other electronic form of payment.

At block 245, the payment request module 135 verifies payment information received from the purchaser to determine whether the purchaser has provided a sufficient form of payment for the item. The payment request module 135 may verify payment information directly, or may communicate the payment information to the online merchant's payment system via the online merchant network device 145 for verification. If the purchaser submitted payment information is not verified, the method 200 returns to block 230, discussed previously, to determine if the time limit for the gift payment request has been reached. In certain exemplary embodiments, the purchaser may be invited to re-submit payment information if the time limit has not expired. If the purchaser submitted payment information is verified, the method 200 proceeds to block 250. In an exemplary embodiment, payment is received and verified by the gift payment management system 125. In this case, the gift payment management system 125 can communicate the payment receipt and verification to the online merchant network device 145. Then, the gift payment management system 125 pays the online merchant for the item. Such payment can be made at the time of payment by the purchaser. Alternatively, individual payments may be batched together and paid in a lump sum to the online merchant. In an alternative exemplary embodiment, the online merchant processes the payment from the purchaser. In this case, the online merchant network device 145 verifies the payment directly.

At block 250, the payment request module 135 receives transaction confirmation information from the online merchant network device 145, confirming satisfactory payment for purchase of the item. Transaction confirmation information may include a link where the user can access the purchased item(s). The transaction confirmation information also may include a confirmation number. For physical items that must be shipped from the online merchant, the transaction confirmation information may include a shipping tracking information.

At block 255, the payment request module 135 generates a gift payment acceptance notification. The gift payment notification indicates the item purchased and transaction confirmation information from the purchaser. The gift payment notification also may include purchaser information. In addition, the gift payment notification may include a personalized message submitted by the purchaser. The gift payment acceptance notification is communicated to the user via the user network device 105. Because the gift payment request is linked to the user account 156, purchase of the item from the gift payment request is automatically linked to the user for the user account 156. Accordingly, electronic items are communicated directly to the contact information for the user via the user network device 105, or a link to access the electronic items is communicated directly to the contact information for the user via the user network device 105. In exemplary embodiments, electronic items can comprise group offer vouchers, coupons, music, stored value cards, ringtones, games, game items, tickets, or any other suitable electronic product or printable product. Physical items can be automatically shipped to the user based on the shipping information provided in the user account 156.

At block 260, the payment request module 135 determines if the total quantity of items requested in the gift purchase request have been purchased. If the full quantity of requested items has not purchased, the method 200 returns to block 230, discussed previously, to determine if the gift payment request has expired. If the full quantity of requested items has been purchased, the method 200 proceeds to block 265.

At block 265, the payment request module 135 notifies any remaining potential purchasers that the gift payment request has been filled. The payment request module 135 updates the pending payment request index 140 to remove the corresponding payment request record 141. The payment request module 135 also may communicate gift payment transaction information to the user module 150. The user module 150 may use the gift payment transaction information to update a gift payment purchase history associated with the corresponding user's account. The purchase history can track the items purchased by the user and optionally information on the purchaser, such as number of times the purchaser accepts a gift payment request and the price range of accepted gift payment requests.

From step 265, the method 200 ends.

General

The exemplary methods and blocks described in the embodiments presented herein are illustrative, and, in alternative embodiments, certain blocks can be performed in a different order, in parallel with one another, omitted entirely, and/or combined between different exemplary methods, and/or certain additional blocks can be performed, without departing from the scope and spirit of the invention. Accordingly, such alternative embodiments are included in the invention described herein.

The invention can be used with computer hardware and software that performs the methods and processing functions described above. As will be appreciated by those having ordinary skill in the art, the systems, methods, and procedures described herein can be embodied in a programmable computer, computer executable software, or digital circuitry. The software can be stored on computer readable media. For example, computer readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays ("FPGA"), etc.

Although specific embodiments of the invention have been described above in detail, the description is merely for purposes of illustration. Various modifications of, and equivalent blocks corresponding to, the disclosed aspects of the exemplary embodiments, in addition to those described above, can be made by those having ordinary skill in the art without departing from the spirit and scope of the invention defined in the following claims, the scope of which is to be accorded the broadest interpretation so as to encompass such modifications and equivalent structures.

What is claimed is:

1. A computer-implemented method for distributing a gift payment request for an offer to a potential purchaser, comprising:

communicating, by a computer, an offer to a user, wherein the offer includes information identifying a product for sale;

receiving, by the computer, from a remote computing device associated with a user, a selection to purchase the offer;

in response to receiving the selection to purchase the offer;

displaying, by the computer, payment options on a payment user interface via the remote computing device, the payment options comprising a redirection payment option;

receiving, by a computer, a selection of the redirection payment option, wherein the redirection payment option comprises user identifying information for a user account maintained by the computer for the user and purchaser contact information for a user-identified potential purchaser;

generating, by the computer, a gift payment request comprising the user identifying information, a description of the user-selected offer, and a payment amount being requested from the potential purchaser to purchase the user-selected offer, wherein the gift payment request is linked to the user account maintained by the computer;

distributing, by the computer, the gift payment request to a computing device associated with the user-identified potential purchaser based on the provided purchaser contact information;

receiving, by the computer, an acceptance notification from the computing device associated with the potential purchaser, the acceptance notification comprising payment information for the potential purchaser to pay for the user-selected item;

communicating, by the computer, the payment information received from the potential purchaser computing device to a payment processor to process payment for the user-selected item based on the payment information for the potential purchaser;

communicating, by the computer, to the computing device associated with the user, a notification indicating that the potential purchaser purchased the offer for the user.

2. The method of claim 1, wherein the purchaser contact information comprises an email address, a social network identifier, an instant message identifier, or a phone number that receives SMS/MMS text.

3. The method of claim 1, wherein the information regarding the offer provided in the gift payment request comprises a link to an online merchant selling the offer.

4. The method of claim 1, further comprising receiving a user-generated personalized message from the network device associated with the user, wherein the gift payment request further comprises the user-generated personalized message.

5. The method of claim 1, further comprising:

determining whether the response is received within a pre-defined time limit; and withdrawing the gift payment request if the response is not received within a pre-defined time limit.

6. The method of claim 5, wherein the pre-defined time limit is based on an expiration of the offer.

7. The method of claim 1, wherein the notification comprises an identification of the potential purchaser associated with the network device from which the response is received.

8. The method of claim 1, wherein the acceptance notification comprises a link to access electronically the offer purchased for the user.

9. The method of claim 1, further comprising communicating, by the computer, a purchase notification to a computing device associated with an online merchant offering the product for sale, the purchase notification stating that payment for the offer has been received and instructing the online merchant to provide the offer to the user.

10. A computer-implemented method for distributing a gift payment request for offers to potential purchasers, comprising:

receiving, by a computer, from a remote computing device associated with a user, a selection to purchase an offer;

in response to receiving the selection to purchase the offer;

displaying, by the computer, payment options on a payment user interface via the remote computing device, the payment options including a redirection payment option;

receiving, by a computer, a redirection payment option from a remote computing device associated with a user, wherein the redirection payment option comprises user identifying information, a user-selected offer to purchase, a desired quantity of the offer, and purchaser information for a plurality of user-identified potential purchasers;

generating, by the computer, a gift payment request including information regarding the offer, the desired quantity, and a request for the potential purchasers to purchase the offer for the user;

distributing, by the computer, the gift payment request to a plurality of remote computing associated with the plurality of the potential purchasers;

receiving, by the computer, a first response from a remote computing device associated with a first one of the potential purchasers, the first response comprising a quantity of the offer to be purchased and payment information to pay for the indicated quantity of the offer;

processing, by the computer, the payment information received from the remote computing device associated with the first one of the potential purchasers;

communicating, by the computer, to a network device associated with the user, an acceptance notification indicating that a first quantity of the offer has been purchased for the user;

determining, by the computer, whether the desired quantity of the offer has been purchased for the user; and withdrawing the gift payment request in response to a determination that the desired quantity has been purchased for the user.

11. The method of claim 10, further comprising:

receiving, by the computer, a second response from a remote computing device associated with a second one of the potential purchasers, the second response a quantity of the offer to be purchased and payment information to pay for the indicated quantity of the offer comprising an acceptance of the gift payment request and an indication that the second one of the potential purchasers will purchase the offer for the user;

processing, by the computer, the payment information received from the remote computing device associated with the second one of the potential purchasers communicating, by the computer, to the network device associated with the user, a notification indicating that a second quantity of the offer has been purchased for the user.

12. The method of claim 11, further comprising providing the first one of the offer and providing the second one of the offer.

13. The method of claim 10, wherein the purchaser contact information comprises an email address, a social network identifier, an instant message identifier, or a phone number that receives SMS/MMS text.

14. The method of claim 10, wherein the information regarding the item provided in the gift payment request comprises a link to an online merchant selling the offer.

15. The method of claim 10, further comprising receiving a user-generated personalized message from the network device associated with the user, wherein the gift payment request further comprises the user-generated personalized message.

16. The method of claim 10, further comprising:

determining whether a pre-defined time limit has expired; and withdrawing the gift payment request in response to expiration of the pre-defined time limit.

17. The method of claim 16, wherein the pre-defined time limit is based on an expiration of an offer.

18. The method of claim 10, wherein the notification comprises an identification of the first potential purchaser associated with the network device from which the response is received.

19. The method of claim 10, wherein the acceptance notification comprises a link to access electronically the offer purchased for the user or shipping the offer to a shipping address associated with the user account.

20. The method of claim 10, wherein the processing step comprises communicating a purchase notification to a network device associated with the online merchant, the purchase notification either stating that payment for the item has been received and instructing the online merchant to provide the product or instructing the online merchant to obtain payment from the potential purchaser for the offer and to provide the product.

21. A computer program product, comprising:

a non-transitory computer-executable storage device having computer-readable program instructions embodied thereon that when executed by a computer cause the computer to distribute a gift payment request for an offer to a potential purchaser, the computer-readable program instructions comprising:

computer-readable program code to receive from a remote computing device associated with a user, a selection to purchase an offer;

computer-readable program code to display, in response to receiving the selection to purchase the offer, payment options on a payment user interface to the user via the remote computing device, the payment options including a redirection payment option;

computer-readable program code to receive a customer redirection payment option from a remote computing device associated with a user, wherein the customer redirection payment option includes user information, a user-selected offer, and purchaser contact information for a user-identified potential purchaser;

computer-readable program code to generate, by the computer, a gift payment request comprising an identification of the offer, the purchaser information, and a request for the potential purchaser to purchase the offer for the user, wherein the gift payment request is linked to a user account based on user information in the customer redirection payment request, computer-readable program code to distribute the gift payment request to the potential purchaser;

computer-readable program code to receive a notification from the potential purchaser, the notification comprising an acceptance of decline of the request, wherein if the request is accepted the notification further comprising payment information; and computer-readable program code to process the payment information received from the potential purchaser; and computer-readable program code to communicate to the remote computing device associated with the user a notification indicating that the potential purchaser purchased the offer for the user.

22. The computer program product of claim 21, wherein the offer is a group offer wherein the group offer's terms of sale are predicated on attaining a certain number of purchaser.

23. A system for distributing a gift payment request for an offer to potential purchasers, comprising:

a storage device;

a network device; and a processor communicatively coupled to the storage device and the network device, wherein the processor executes application code instructions that are stored in the storage device and that cause the system to receive from a remote computing device associated with a user a selection to purchase an offer;

display, in response to receiving the selection to purchase an offer, payment options on a payment user interface via the remote computing device, the payment options including a redirection payment option;

receive a request to ask a potential purchaser to purchase a user-selected offer for a user, wherein the request includes user information, an identification of the offer, and purchaser information for the potential purchaser;

generate a gift payment request including the offer and the purchaser information, and a payment amount being requested from the potential purchaser, wherein the gift payment request is linked to a user account based on the user information in the customer redirection payment request;

distribute the gift payment request to the potential purchaser;

receive payment from the potential purchaser for the offer process the payment received from the potential purchaser; and notify the user that the potential purchaser purchased the offer for the user.

24. The system of claim 23, wherein the offer is a group offer, wherein the group offer's terms of sale are predicated on attaining a certain number of purchasers.

* * * * *

UNITED STATES PATENT AND TRADEMARK OFFICE

CERTIFICATE OF CORRECTION

PATENT NO. : 8,595,059 B1
APPLICATION NO. : 13/271284
DATED : November 26, 2013
INVENTOR(S) : Andy Huang It is certified that error appears in the above-identified patent and that said Letters Patent is hereby corrected as shown below:

In the Claims:

Col. 13, Claim 22, line 12: "a certain number of purchaser" should read --a certain number of purchasers--.

Signed and Sealed this
Second Day of December, 2014

Michelle K. Lee

Michelle K. Lee
*Deputy Director of the United States Patent and Trademark Office*